US011278904B2

(12) United States Patent
Carty et al.

(10) Patent No.: US 11,278,904 B2
(45) Date of Patent: Mar. 22, 2022

(54) CONTAINER FOR A SPECIMEN AND METHOD OF USING SAME

(71) Applicant: QUEST DIAGNOSTICS INVESTMENTS LLC, Secaucus, NJ (US)

(72) Inventors: Daniel E. Carty, Sudbury, MA (US); Fredric Solomon, West Orange, NJ (US)

(73) Assignee: Quest Diagnostics Investments LLC, Secaucus, NJ (US)

( * ) Notice: Subject to any disclaimer, the term of this patent is extended or adjusted under 35 U.S.C. 154(b) by 0 days.

(21) Appl. No.: 16/634,036

(22) PCT Filed: Jul. 27, 2018

(86) PCT No.: PCT/US2018/044117
§ 371 (c)(1),
(2) Date: Jan. 24, 2020

(87) PCT Pub. No.: WO2019/023593
PCT Pub. Date: Jan. 31, 2019

(65) Prior Publication Data

US 2020/0384475 A1 Dec. 10, 2020

Related U.S. Application Data

(60) Provisional application No. 62/538,301, filed on Jul. 28, 2017.

(51) Int. Cl.
*G09F 3/10* (2006.01)
*B01L 3/00* (2006.01)
(Continued)

(52) U.S. Cl.
CPC ..... *B01L 3/5453* (2013.01); *G09F 3/0288* (2013.01); *G09F 3/0297* (2013.01);
(Continued)

(58) Field of Classification Search
CPC ..... B01L 3/5453
See application file for complete search history.

(56) References Cited

U.S. PATENT DOCUMENTS 1,949,903 A * 3/1934 Fales ..... G09F 3/0288 434/298
3,750,317 A * 8/1973 Morgan ..... G09F 3/0288 283/103

(Continued)

FOREIGN PATENT DOCUMENTS

JP 4445045 B2 4/2010

OTHER PUBLICATIONS

International Search Report and Written Opinion in International Application No. PCT/US2018/044117 dated Oct. 10, 2018, 6 pages.

(Continued)

*Primary Examiner* — Cassandra Davis
(74) *Attorney, Agent, or Firm* — Foley & Lardner LLP

(57) ABSTRACT

A container for a specimen includes a container configured to receive a specimen for evaluation, a first label disposed on the container and having identifying information, and a second label disposed on the container so as to entirely cover at least all perimeter edges of the first label. The second label includes a viewing portion that allows for evaluation of the specimen and an identification portion configured to receive identifying information. Methods for using the container for a specimen are also disclosed.

21 Claims, 5 Drawing Sheets

(51) Int. Cl.
*G09F 3/02* (2006.01)
*G09F 3/00* (2006.01)

(52) U.S. Cl.
CPC ..... *G09F 3/10* (2013.01); *B01L 2300/021* (2013.01); *G09F 2003/0245* (2013.01); *G09F 2003/0272* (2013.01)

(56) References Cited

U.S. PATENT DOCUMENTS 4,884,827 A 12/1989 Kelley
5,495,944 A * 3/1996 Lermer ..... G09F 3/0292 206/459.1
2003/0075918 A1* 4/2003 Levine ..... G09F 3/0288 283/81
2004/0166277 A1 8/2004 Key
2005/0258636 A1* 11/2005 Bova ..... G09F 3/10 283/81
2008/0188814 A1* 8/2008 Lavi-Loebl ..... G09F 3/10 604/189
2008/0276504 A1* 11/2008 Cloninger ..... G09F 3/0288 40/312
2009/0068389 A1* 3/2009 Maule ..... C09J 7/29 428/41.6
2012/0210778 A1* 8/2012 Palmer ..... G01F 17/00 73/149
2013/0036634 A1* 2/2013 Key ..... G09F 3/04 40/5
2013/0105064 A1 5/2013 Stevens et al.
2013/0177486 A1* 7/2013 Gelfand ..... G06K 19/06046 422/547
2020/0251021 A1* 8/2020 Woodburn ..... B32B 29/005

OTHER PUBLICATIONS

Supplemental European Search Report dated Feb. 24, 2021 in EP 18839043.9.

* cited by examiner

CONTAINER FOR A SPECIMEN AND METHOD OF USING SAME

CROSS-REFERENCE TO RELATED APPLICATION

The present application is a U.S. National Stage of International Application No. PCT/US2018/044117 filed on Jul. 27, 2018, which claims the benefit of U.S. Provisional Patent Application No. 62/538,301 filed on Jul. 28, 2017, the entire disclosures of all of which are incorporated herein by reference.

FIELD

The present disclosure relates generally to containers for a specimen and methods of using the same.

BACKGROUND

A provider of specimens for testing will provide a container for a specimen (such as a test tube) containing a specimen for testing. The provider places a specimen in a container and provides the container to a tester to conduct testing of the specimen in the container for a specimen. Prior to providing the container for the specimen to the tester, the provider will pre-label the container with a provider's label. The provider's label typically includes a bar code, which the provider uses for identification purposes. The provider's label typically includes information relating to patient identification, date of collection of the specimen, and desired testing procedures to be performed on the specimen.

When the tester receives the container holding the specimen from the provider, the tester will use automated processing systems and equipment having electronic vision detection equipment to verify, for example, the contents and volume of the specimen held in the container for a specimen. The electronic vision detection equipment verifies that both the content and volume of the specimen are sufficient for the desired testing procedures to be performed on the specimen. The tester applies its own tester's label to the container, which may include a bar code that the tester uses for identification purposes. The automation line, and the electronic vision detection equipment in particular, are configured to automatically read bar codes, so the tester's label must be applied in such a configuration as to cover any bar code present on the provider's label on the container for a specimen.

Because the provider's label often has exposed edges which begin to peel back either prior to or after the application of the tester's label, the exposed edges have the potential to disrupt the tester's automated processing systems and equipment. For example, once placed in a tester's automation line, exposed edges of the provider's label can flare back. Once the exposed edges flare back, an adhesive exposed on a back side of the provider's label sticks to other specimen tubes, transport equipment, or testing devices, leading to spillage of at least a portion of the contents of the specimen tubes on the automation line. Thus, the automation line would need to be shut down while any disruptive specimen tubes are removed from the line and remedied prior to replacing the specimen tube back on the automation line.

Consequently, there is a need for devices and methods for a container for a specimen having labels which prevent exposed edges of a provider's labels and which ensure that vision detection equipment during automated processing of the container can accurately and reliably detect and verify the contents and volume of a specimen in the container.

SUMMARY

According to one exemplary embodiment of the present disclosure, a method of using a container for a specimen includes the steps of receiving a container having a specimen for evaluation and a first label disposed on the container and having identifying information and applying a second label on the container so as to entirely cover at least all perimeter edges of the first label. The second label includes a viewing portion that allows for evaluation of the specimen and an identification portion configured to receive identifying information.

According to one aspect, the identifying information on the first label includes at least information related to the specimen within the container.

According to a further aspect, the viewing portion of the second label is substantially transparent.

According to a still further aspect, the identification portion of the second label is opaque.

According to a still further aspect, the method also includes the step of applying identifying information on the identification portion of the second label at least one of before and after applying the second label on the container.

According to a still further aspect, the identifying information on the second label includes at least information related to the specimen within the container.

According to a still further aspect, the method also includes the step of evaluating the specimen in the container through the viewing portion of the second label.

According to one exemplary embodiment of the present disclosure, a container for a specimen includes a container configured to receive a specimen for evaluation, a first label disposed on the container and having identifying information, and a second label disposed on the container so as to entirely cover at least all perimeter edges of the first label. The second label includes a viewing portion that allows for evaluation of the specimen and an identification portion configured to receive identifying information.

According to one aspect, the identifying information on the first label includes at least information related to the specimen within the container.

According to a further aspect, the viewing portion of the second label is substantially transparent.

According to a still further aspect, the identification portion of the second label is opaque.

According to a still further aspect, the second label also includes identifying information on the identification portion of the second label.

According to a still further aspect, the identifying information on the second label includes at least information related to the specimen within the container.

DETAILED DESCRIPTION

Referring generally to the FIGURES, methods and devices are shown and described for a container for a specimen having a single-piece, two-part label applied to an outer surface of the container for a specimen and over and above a pre-applied label applied to the outer surface of the container for a specimen.

Figure 1:
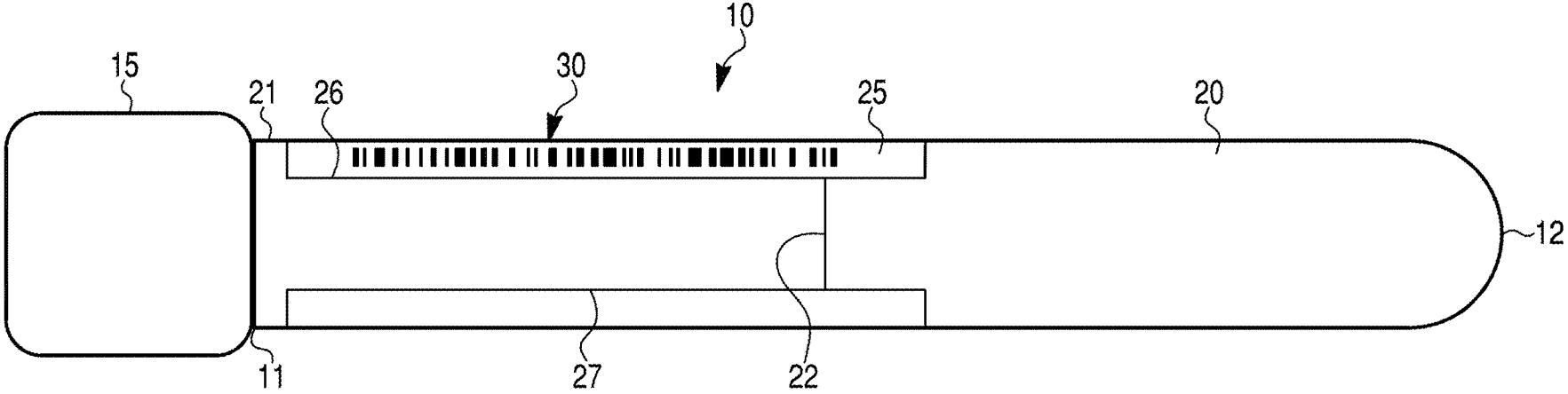
FIG. 1 Prior Art
FIG. 1 is a side view of a container for a specimen having a first label applied to an outer surface of the container for a specimen, according to the prior art.

FIG. 1 shows a container for a specimen having a provider's label applied to the container. The container (e.g., a test tube) is configured to hold a specimen (e.g., a medical specimen) for testing and is provided by a provider to a tester for testing procedures. As shown in FIG. 1, container 10 includes a first, open end 11 and a second, closed end 12. Cap 15 is configured to fit onto or over open end 11 and is configured to seal container 10 such that a specimen held inside container 10 does not spill out of container 10. Container 10 includes a first portion 20 which holds the specimen contained within container 10 and a second portion 21 which remains empty. Second portion 21 is disposed between open end 11 and first portion 20 in the container 10. Liquid interface 22 defines a boundary between first portion 20 and second portion 21 of container 10. A first label (e.g., a provider's label) 25 is disposed on the container 10 (for example, on an outer surface of container 10), and includes identifying information (such as bar code 30) placed on the label 25 by the provider. The identifying information (e.g., bar code 30) includes information related to the specimen which is held inside container 10. Label 25 includes a first edge 26 and a second edge 27 and is configured such that the label 25 does not extend completely around an outer circumference of container 10, as shown in FIG. 1.

I. Embodiment of a Container Device

A. Overview

According to one exemplary embodiment, a container for a specimen (e.g., a test tube, etc.) includes a container configured to receive a specimen for evaluation (e.g., testing, verification, etc.), a first label (e.g., a provider's label) disposed on the container, and a second label (e.g., a tester's label) disposed on the container and over and on top of the first label such that the second label entirely covers at least all perimeter edges of the first label. The first label includes identifying information or other information, for example, information related to the specimen held in container. The second label includes a viewing portion or window which allows for evaluation, inspection, and/or verification of the specimen held in the container. The second label further includes an identification portion configured to receive identifying information or other information, for example, information related to the specimen held in the container, such as information related to desired testing or other procedures to be conducted on the specimen.

B. Single-Piece, Two-Part Label

Figure 2:
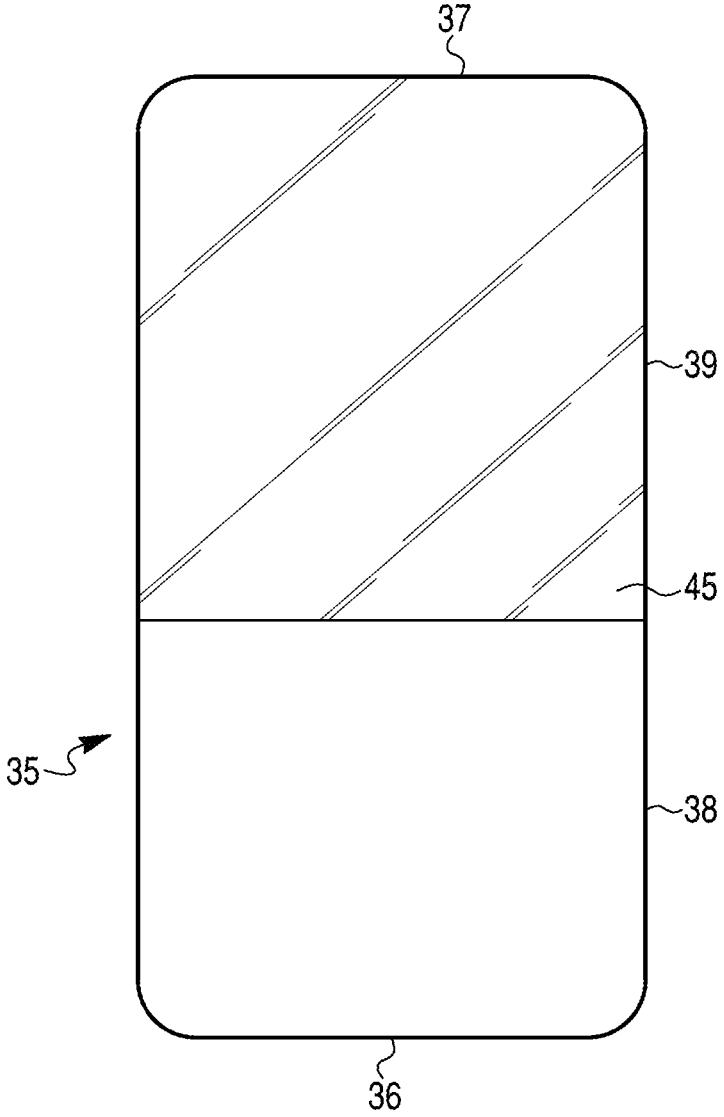
FIG. 2 is a front view of a single-piece, two-part label configured to be applied to a container for a specimen.
Figure 3:
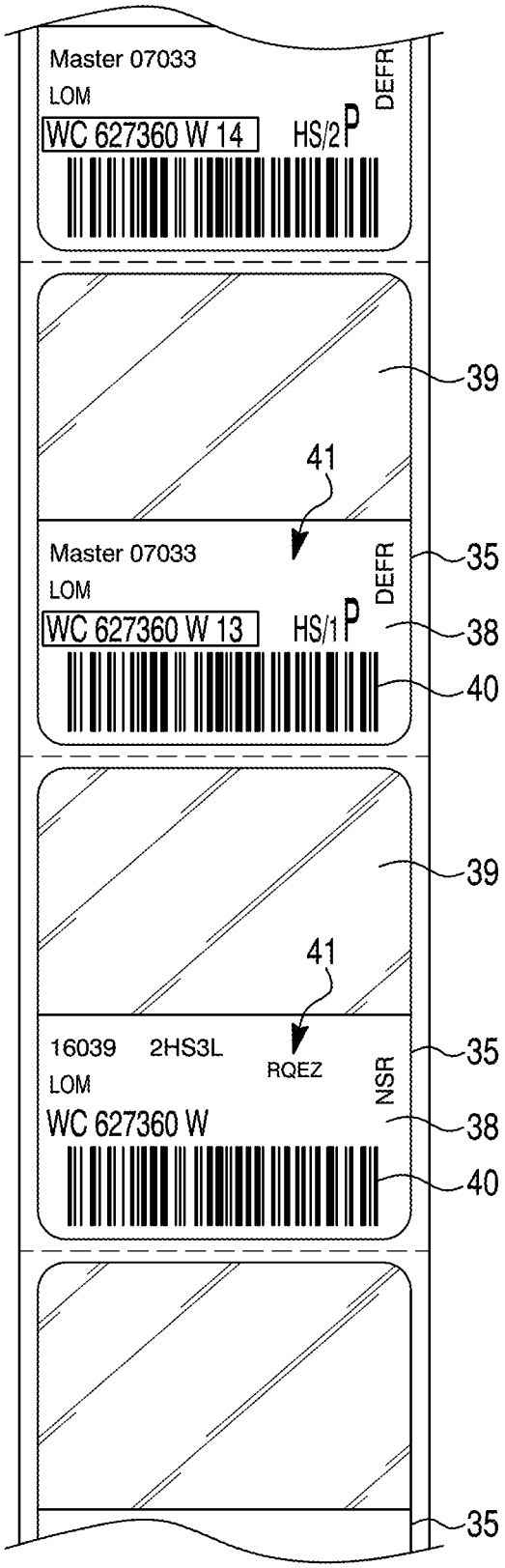
FIG. 3 is a front view of a series of single-piece, two-part labels as shown in FIG. 2 after identifying information has been applied to the single-piece, two-part labels.

A tester's label 35 is shown in FIG. 2. Label 35 is a single-piece, two-part label and includes a first edge 36 and a second edge 37. Label 35 is made of any suitable material, for example, clear thermal transfer polypropylene. Label 35 is of any size and shape suitable for applying or affixing label 35 onto container 10 once a provider has provided container 10 to a tester for specimen testing. Preferably, label 35 is sized and configured so as to fully cover a provider's label 25. In one example, label 35 has a substantially rectangular shape. As a more specific example, label 35 has a substantially rectangular shape of about 1¾ inches in width and about 2¼ inches in length. A label 35 is manufactured from stock material; in some aspects, the label is die cut with an approximately ⅛ inch gap with perforation between multiple labels formed on a same sheet of stock material, as shown in FIG. 3.

Figure 5:
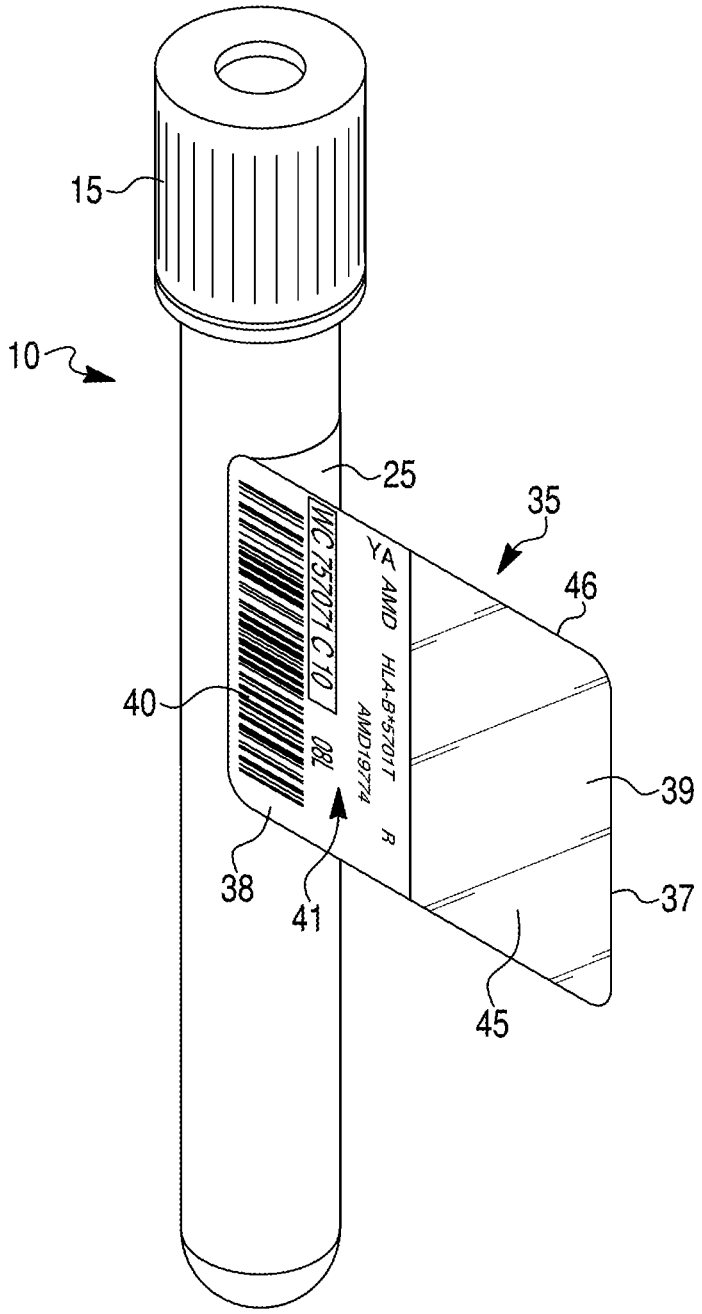
FIG. 5 is a perspective view of a single-piece, two-part label as shown in FIG. 2 being applied to a container for a specimen.

Label 35 has a front surface 45, as shown in FIG. 2, and a back surface 46, as shown in FIG. 5. Back surface 46 includes an adhesive disposed on at least a portion of back surface 46 and is configured to securably attach or affix label 35 to an outside surface of container 10 or a provider's label 25 already affixed or attached to container 10. According to one aspect, the adhesive is disposed on an entirety of back surface 46 of label 35. The adhesive may be any suitable material which will securably attach or affix label 35 to container 10 or label 25 and prevent at least a portion or edge of label 35 from being detached from container 10 or label 25 during testing or processing of container 10. For example, the adhesive can be any commercially available adhesive suitable for use on a specimen container (e.g., a test tube). Using the adhesive on back surface 46, label 35 fastens down both label 35 and any underlying provider's label or labels 25.

1. Identification Portion of the Label

Referring again to FIG. 2, label 35 includes a first portion 38. First portion 38 is configured such that identification information or other information can be imprinted or written on the first portion 38 prior to or after label 35 is affixed or applied to container 10. In one aspect, first portion 38 is formed during the process for manufacturing label 35. In one aspect, first portion 38 is formed as a white imprint area on label 35. As one example, first portion 38 is created by printing a gray primer on a portion of label 35, following by a double printing of white ink on the portion of label 35. First portion 38, in one aspect, is opaque such that a reader (e.g., a person, vision detection equipment, an electric eye, etc.) can easily determine or detect information imprinted or written on first portion 38. First portion 38 of label 35 is of any suitable size and shape such that information can be imprinted or written on it. According to one aspect, first portion 38 is an area of about 1 inch in length and is disposed along an entire width of first edge 36 of label 35. Because the length of first portion 38 extends about 1 inch along the length of label 35, about 1 inch of the length of label 35 defines the length of first portion 38 and about 1¼ inches of the length of label 35 defines the length of second portion 39, as described below. According to one aspect, first portion 38 has a same size as a corresponding printable area or portion on provider's label 25. According to another aspect, first portion 38 has a different size as a corresponding printable area or portion on provider's label 25.

After first portion 38 is formed on label 35, identification information or other information in any suitable form are imprinted or written on first portion 38. As one example, a bar code 40 with identifying information is imprinted on first portion 38, as shown in FIG. 3. According to one aspect, as shown in FIG. 3, additional information 41 (e.g., other identifying information, etc.) is imprinted or written on first portion 38 of label 35 by similar or different means as the bar code 40 is placed on first portion 38. According to one aspect, identification information or other information is applied to first portion 38 before label 35 is applied to container 10. According to a further aspect, identification information or other information is applied to first portion 38 after label 35 is applied to container 10. According to a still further aspect, identification information or other information is applied to first portion 38 both before and after label 35 is applied to container 10. The identification information or other information includes, for example, information related to a specimen which is held in container 10 to which label 35 is applied or affixed.

2. Viewing Portion of the Label

Label 35 also includes a second portion 39, as shown in FIG. 2. Second portion 39 is any suitable size and shape. In one aspect, the size and shape of second portion 39 are both the same as the size and shape of first portion 38. In another aspect, only one of the size and shape of second portion 39 is the same as corresponding size or shape of first portion 38. In still another aspect, both the size and shape of second portion 39 are different from the corresponding size and shape of first portion 38. As a specific example, second portion 39 has a larger size than first portion 38. As another specific example, second portion 39 has a same width as first portion 38 but second portion 39 has a different length than first portion 38. Specifically, as described above, when first portion 38 has a length of about 1 inch along the length of label 35, second portion 39 has a length of about 1¼ inches. Second portion 39 is configured to form a viewing portion or window when label 35 is applied to container 10. The viewing portion or window formed by second portion 39 is configured to allow evaluation of the specimen held in container 10. The second portion 39 can be configured, for example, so that it (i) does not extend into a gap in the provider's label 25; (ii) extends completely over the gap in the provider's label 25 (e.g., such that an edge of the second portion 39 is not positioned within the gap, which might negatively impact viewing); or (iii) extends completely over the gap in the provider's label 25 and partially or fully over the first portion 38 (e.g., to protect the first portion 38 and information thereon). The evaluation of the specimen is conducted by any suitable means, for example, by manual inspection or by automated processing systems or equipment (e.g., vision detection equipment, an electric eye, etc.). In one aspect, second portion 39 is substantially transparent to facilitate evaluation of the specimen in container 10.

3. Container with Single-Piece, Two-Part Label

Figure 4:
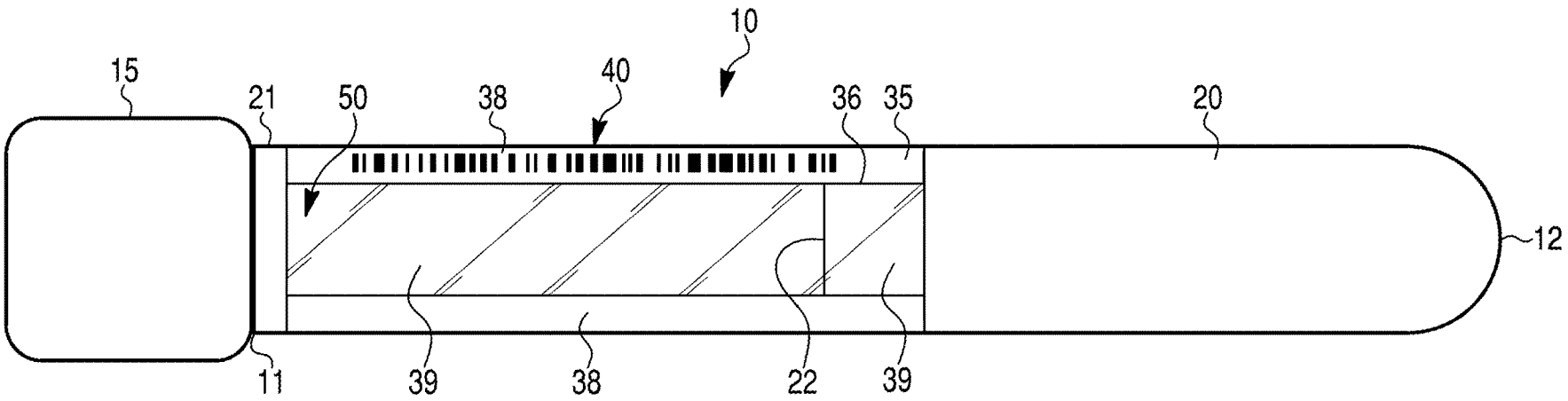
FIG. 4 is a side view of a container for a specimen having a single-piece, two-part label applied to an outer surface of the container for a specimen entirely covering a first label applied to the outer surface of the container for a specimen.

Referring now to FIG. 4, a container 10 is shown with tester's label 35 affixed or attached to container 10. Container 10 includes a first, open end 11 and a second, closed end 12. Cap 15 is configured to fit onto or over open end 11 and is configured to seal container 10 such that a specimen held inside container 10 does not spill out of container 10. Container 10 includes a first portion 20 which holds the specimen contained within container 10 and a second portion 21 which remains empty. Second portion 21 is disposed between open end 11 and first portion 20 in the container 10. Liquid interface 22 defines a boundary between first portion 20 and second portion 21 of container 10. Label 35 is affixed or attached to container 10 and/or label 25 which a provider has already affixed or attached to container 10. Label 35 is affixed or attached to container 10 such that label 35 completely or entirely covers at least all perimeter edges of label 25 which is affixed or attached to container 10 (as shown in FIG. 1). Label 35 according to one aspect covers all of an outer surface of container 10. According to a further aspect, label 35 covers only a portion of an outer surface of container 10. Label 35 preferably is configured to cover all perimeter edges of label 25 so that all exposed edges of label 25 are covered and thereby prevent any exposed edges of label 25 from peeling back either prior to or after application of label 35 onto container 10 and/or over label 25. Accordingly, label 35 prevents any exposed edges of label 25 from flaring back and/or sticking to other containers or specimen tubes, transport equipment, or testing devices which potentially leads to spillage of specimen contents held in container 10. Once label 35 is applied or affixed to container 10 and/or over label 25 on container 10 as described above, second portion 39 of label 35 forms a viewing window through which specimen contents of container 10 can be viewed or evaluated, either by manual inspection or by automated processing systems or equipment (e.g., vision detection equipment, an electric eye, etc.). Preferably, the second portion 39 provides a direct and unobstructed view of the specimen contents from outside the container 10 through the viewing window.

II. Embodiment of a Method of Using a Container for a Specimen

A. Overview

According to an exemplary embodiment, a method of using a container for a specimen includes receiving a container having a specimen for evaluation (e.g., inspection, verification, testing, etc.) and a first label (e.g., a provider's label) disposed on the container and having identifying information, and applying a second label (e.g., a tester's label) to the container so as to entirely cover at least all perimeter edges of the first label. The second label includes a viewing portion (e.g., a viewing window) that allows for evaluation of the specimen and an identification portion configured to receive identifying information (e.g., a bar code).

B. Method

As shown in FIG. 5, container 10 holding a specimen is shown as a tester's label 35 is being applied or affixed to an outer surface of container 10 and over (e.g., on top of) a provider's label 25 which has already been applied to an outer surface of container 10. According to some aspects, label 25 includes at least information related to the specimen held by container 10.

Label 35 can be configured as set forth in the embodiment of the container device described above. For example, label 35 can include a first portion 38 and a second portion 39. First portion 38 is configured to be an identification portion to receive identifying information, such as bar code 40 or other additional information 41 (shown in FIG. 3). According to some aspects, first portion 38 is opaque. Second portion 39 is configured to provide a viewing portion 50 (shown in FIG. 4) such that when label 35 is applied or affixed to container 10, viewing portion 39 allows for evaluation of the specimen held within or by container 10. According to some aspects, second portion 39 is substantially transparent. For example, second portion 39 is entirely transparent. Viewing portion 39 is configured to allow, for example, automated evaluation of the specimen. As another example, viewing portion 39 is configured to allow for manual evaluation of the specimen.

Label 35 also includes a front surface 45 and a back surface 46. Back surface 46 has an adhesive covering at least a portion of back surface 46 and is configured to releasably secure label 35 to an outer surface of container 10. Label 35 also includes a first end or edge 36 (shown in FIG. 4) and a second end or edge 37 (shown in FIG. 2). Label 35 is applied or affixed to an outer surface of container 10 by first releasably securing end or edge 36 to a position on the outer surface of container 10 or over provider's label 25 previously applied to container 10 and wrapping label 35 around the outer surface of container 10 until all of label 35 is applied to the outer surface of container 10. Label 35 is applied over the provider's label 25 so as to entirely cover at least all perimeter edges of the provider's label 25 to prevent at least any perimeter edge of label 25 from becoming exposed during testing processes or procedures of container 10 or the specimen held by container 10. To secure label 35 to the outer surface of container 10, end or edge 37 of label 35 is releasably secured (e.g., attached, affixed, etc.) to the outer surface of container 10.

According to some aspects, the method further includes the step of applying (e.g., printing, writing, etc.) identifying information on the identification portion 38 of label 35. The applying identifying information on the identification portion 38 is performed, for example, before label 35 is applied or affixed to an outer surface of container 10. As a further example, the applying identifying information on the identification portion 38 is performed after label 35 is applied or affixed to an outer surface of container 10. As a still further example, the applying identifying information on the identification portion 38 is applied both before and after label 35 is applied or affixed to an outer surface of container 10.

According to some aspects, the identifying information on the label 35 (e.g., bar code 40 or other identifying information 41) includes at least information related to the specimen held by container 10.

According to some aspects, the method further includes the step of evaluating the specimen in container 10. The evaluating the specimen is accomplished by, for example, inspecting or otherwise evaluating the specimen through viewing portion or window 50 (shown in FIG. 4). The evaluating the specimen is, in some examples, manually performed. In other examples, the evaluating the specimen is automated (e.g., by using an electronic eye or similar automated processing equipment). Evaluating the specimen held in container 10, for example, is to verify the contents of the specimen held by container 10. As a further example, evaluating the specimen held in container 10 is to verify or ascertain the amount and/or volume of the specimen held by container 10. As a still further example, evaluating the specimen held in container 10 is to identify the contents of the specimen held by container 10. Evaluating the specimen, as a still further example, includes testing the specimen (e.g., testing the specimen pursuant to the instructions provided to the tester by the provider of the container 10, for example, by instructions provided on label 25). Testing processes or procedures are automated, according to some aspects. According to other aspects, the testing processes or procedures are manually performed.

The construction and arrangement of the devices and methods as shown in the various exemplary embodiments are illustrative only. Although only a few embodiments have been described in detail in this disclosure, many modifications are possible (e.g., variations in sizes, dimensions, structures, shapes, and proportions of the various elements, values of parameters, mounting arrangements, use of materials, colors, orientations, etc.). For example, the position of elements may be reversed or otherwise varied and the nature or number of discrete elements or portions may be altered or varied. Accordingly, all such modifications are intended to be included within the scope of the present disclosure. The order or sequence of any process or method steps may be varied or re-sequenced according to alternative embodiments. Other substitutions, modifications, changes, and omissions may be made in the design, operating conditions, and arrangement of the exemplary embodiments without departing from the scope of the present disclosure.

What is claimed is:

1. A method of using a container for a specimen, comprising:

receiving a container having a specimen for evaluation and a first label disposed on the container and having identifying information; and applying a second label, having a viewing portion that allows for evaluation of the specimen and an identification portion configured to receive identifying information, on the container so as to entirely cover at least all perimeter edges of the first label and such that the identification portion covers the identifying information on the first label.

2. The method of claim 1, wherein the identifying information on the first label includes at least information related to the specimen within the container.

3. The method of claim 2, wherein the identifying information on the first label includes at least one of information relating to patient identification, a date of collection of the specimen, or desired procedures to be conducted on the specimen.

4. The method of claim 3, further comprising applying identifying information on the identification portion of the second label at least one of before and after applying the second label on the container, the identifying information including at least information related to desired procedures to be conducted on the specimen.

5. The method of claim 1, wherein the viewing portion of the second label is substantially transparent.

6. The method of claim 1, wherein the identification portion of the second label is opaque.

7. The method of claim 1, further comprising applying identifying information on the identification portion of the second label at least one of before and after applying the second label on the container.

8. The method of claim 7, wherein the identifying information on the second label includes at least information related to the specimen within the container.

9. The method of claim 1, further comprising evaluating the specimen in the container through the viewing portion of the second label.

10. The method of claim 1, wherein the identification portion of the second label is disposed on the container so as to entirely cover the identifying information on the first label.

11. The method of claim 1, wherein the viewing portion extends from a top edge of the second label to a bottom edge of the second label along a length direction of the container.

12. A container for a specimen, comprising:

a container configured to receive a specimen for evaluation;

a first label disposed on the container and having identifying information; and a second label, having a viewing portion that allows for evaluation of the specimen and an identification portion configured to receive identifying information, disposed on the container so as to entirely cover at least all perimeter edges of the first label and such that the identification portion covers the identifying information on the first label.

13. The container of claim 12, wherein the identifying information on the first label includes at least information related to the specimen within the container.

14. The container of claim 13, wherein the identifying information on the first label includes at least one of information relating to patient identification, a date of collection of the specimen, or desired procedures to be conducted on the specimen.

15. The container of claim 14, wherein the identification portion of the second label comprises identifying information including at least information related to desired procedures to be conducted on the specimen.

16. The container of claim 12, wherein the viewing portion of the second label is substantially transparent.

17. The container of claim 12, wherein the identification portion of the second label is opaque.

18. The container of claim 12, further comprising identifying information applied on the identification portion of the second label.

19. The container of claim 18, wherein the identifying information on the second label includes at least information related to the specimen within the container.

20. The container of claim 12, wherein the identification portion of the second label is disposed on the container so as to entirely cover the identifying information on the first label.

21. The container of claim 12, wherein the viewing portion extends from a top edge of the second label to a bottom edge of the second label along a length direction of the container.

* * * * *